US011389690B2

(12) United States Patent
Valdez et al.

(10) Patent No.: US 11,389,690 B2
(45) Date of Patent: Jul. 19, 2022

(54) MULTI-USE FITNESS MACHINE AND METHODS OF USE

(71) Applicant: KONDITION, INC., Santa Monica, CA (US)

(72) Inventors: Daniel Carlos Valdez, Venice, CA (US); Ken Carter, Claremont, CA (US)

(73) Assignee: KONDITION, INC., Ventura, CA (US)

( * ) Notice: Subject to any disclaimer, the term of this patent is extended or adjusted under 35 U.S.C. 154(b) by 0 days.

(21) Appl. No.: 16/571,052

(22) Filed: Sep. 13, 2019

(65) Prior Publication Data

US 2020/0086165 A1 Mar. 19, 2020

Related U.S. Application Data

(60) Provisional application No. 62/731,077, filed on Sep. 13, 2018.

(51) Int. Cl.

| | |
|---|---|
| ***A63B 21/00*** | (2006.01) |
| ***A63B 1/00*** | (2006.01) |
| ***A63B 21/08*** | (2006.01) |
| ***A63B 23/04*** | (2006.01) |

(52) U.S. Cl.

CPC ..... *A63B 21/4033* (2015.10); *A63B 1/00* (2013.01); *A63B 21/08* (2013.01); *A63B 21/159* (2013.01); *A63B 21/4035* (2015.10); *A63B 23/0405* (2013.01); *A63B 2023/0411* (2013.01)

(58) Field of Classification Search

CPC ..... A63B 21/4033; A63B 21/072; A63B 3/00; A63B 21/4035; A63B 1/00; A63B 21/159; A63B 21/08; A63B 23/0405; A63B 2023/0411; A63B 21/0724; A63B 21/0726; A63B 21/0728; A63B 21/075; A63B 21/078; A63B 21/0783

See application file for complete search history.

(56) References Cited

U.S. PATENT DOCUMENTS

| | | | | |
|---|---|---|---|---|
| 4,795,149 A * | 1/1989 | Pearson | ..... | A63B 21/078 482/133 |
| 5,669,859 A * | 9/1997 | Liggett | ..... | A63B 21/078 482/101 |
| 8,328,698 B1 * | 12/2012 | Webber | ..... | A63B 71/0036 482/104 |
| 10,576,322 B2 * | 3/2020 | Schlegel | ..... | A63B 69/34 |

(Continued)

*Primary Examiner* — Andrew S Lo
*Assistant Examiner* — Andrew M Kobylarz
(74) *Attorney, Agent, or Firm* — Ferguson Case Orr Paterson

(57) ABSTRACT

A fitness machine enabling several lunge and squat-style exercises comprises a frame that provides the basic structure of the machine. The frame includes a set of horizontal beams and a set of vertical beams creating a rectangular interior exercise space for a user to stand. A handle is included with each horizontal guide rail that slides forward and backward along the horizontal guide rail. The horizontal guide rail is movably connected between two of the vertical guide rails such that the horizontal guide rail freely slides up and down the vertical guide rails, ensuring that the horizontal guide rail maintains a parallel relationship with the floor throughout the entire range of motion during use. The handles and the horizontal guide rails significantly improve the user's balance during the exercise, eliminating unnecessary stress on the knees, hips, and lower back.

12 Claims, 14 Drawing Sheets

(56) References Cited

U.S. PATENT DOCUMENTS

| | | | | |
|---|---|---|---|---|
| 10,646,740 | B2 * | 5/2020 | Lee | A63B 21/156 |
| 2005/0202941 | A1 * | 9/2005 | Vaes | A63B 21/0632<br>482/94 |
| 2007/0203002 | A1 * | 8/2007 | Webber | A63B 21/078<br>482/104 |
| 2009/0124469 | A1 * | 5/2009 | Webber | A63B 21/078<br>482/98 |
| 2017/0007876 | A1 * | 1/2017 | Lu | A63B 21/078 |
| 2018/0243597 | A1 * | 8/2018 | Schlegel | A63B 71/023 |
| 2019/0134452 | A1 * | 5/2019 | Schween | A63B 21/0783 |

* cited by examiner

MULTI-USE FITNESS MACHINE AND METHODS OF USE

RELATED APPLICATION

This application claims the benefit of U.S. Provisional Application No. 62/731,077, filed on Sep. 13, 2018. The application referred to in this paragraph is incorporated by reference as if set forth fully herein.

BACKGROUND OF THE DISCLOSURE

Field of the Disclosure

The disclosure relates generally to fitness machines, and, more particularly, to multi-use fitness machines that are well-suited for lunge and squat-style exercises and methods of use thereof.

Description of the Related Art

Lunges and squats are popular exercises practiced around the globe to tone and build muscle in the human lower body. Squats and similar exercises are often performed using squat racks or a multipurpose Smith machine. These devices have been a staple piece of gym equipment since the 1950s. Smith machines consist of a barbell that is fixed within steel rails allowing only vertical or near-vertical movement. Some Smith machines have the barbell counterbalanced. The machine can be used for a wide variety of exercises though it is most commonly used to perform "Smith machine squats."

Lunges and similar exercises are typically performed without a rack, for example along a stretch of path where the user modifies a normal walking motion to achieve the lunge motion. A lunge can refer to any position of the human body where one leg is positioned forward with knee bent and foot flat on the ground while the other leg is positioned behind. It is used by athletes in cross-training for sports and by weight-trainers as a fitness exercise. A lunge can be performed using bodyweight alone. However, weight trainers may seek to increase the difficulty using either dumbbells or kettlebells held in each hand, or a barbell held atop the neck and shoulders.

These known exercise devices suffer from several disadvantages. For example, use of the Smith machine has been criticized by many strength trainers as it forces the user to adopt an unnatural straight-up-and-down bar path which can put shear stress on the knees or back. Lunge exercises can cause pain in the knees, which is sometimes caused by lateral imbalance during the exercise.

Thus, there is a need for a device in the fitness industry that does not suffer from these and other drawbacks.

DESCRIPTION OF THE DISCLOSURE

The present invention is described herein with reference to certain embodiments, but it is understood that the invention can be embodied in many different forms and should not be construed as limited to the embodiments set forth herein.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Figure 1:
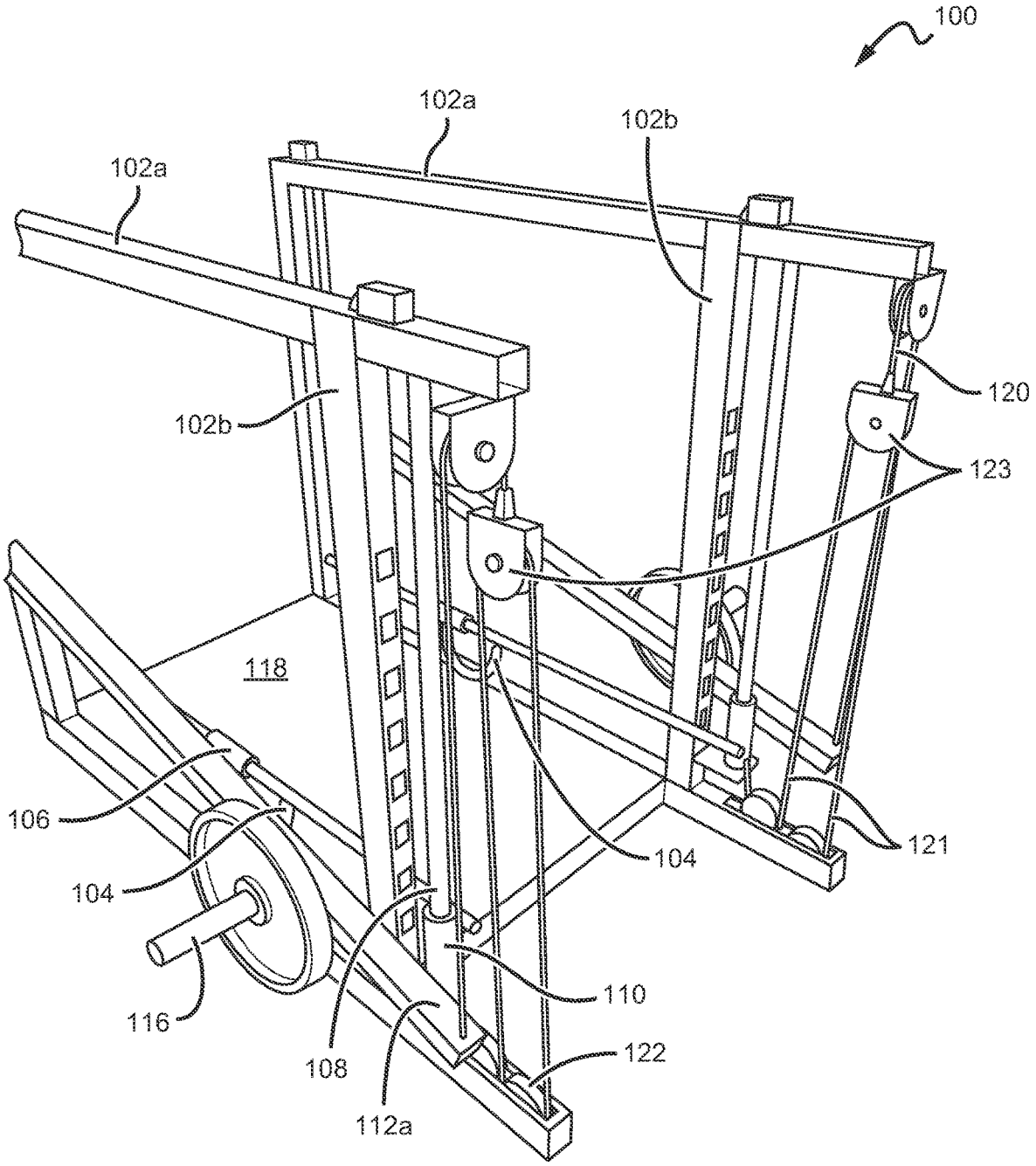
FIG. 1 is a front perspective view of a fitness machine 100 according to an embodiment of the present disclosure.

FIG. 1 is a front perspective view of a fitness machine 100 according to an embodiment of the present disclosure. The machine 100 comprises a frame 102 that provides the basic structure of the machine 100. In one embodiment, the frame 102 comprises four horizontal beams 102*a* and four vertical beams 102*b*, creating a rectangular interior space for the user to stand. At least one handle 104 is included that slides forward and backward along at least one horizontal guide rail 106. In this particular embodiment, there are two handles 104 connected, one each, to two horizontal guide rails 106 are movably connected to four vertical guide rails 108 such that the horizontal guide rails 106 freely slide up and down the vertical guide rails 108, ensuring that the horizontal guide rails 106 maintain a parallel relationship with the floor throughout the entire range of motion during use. Sleeves 110 allow the horizontal guide rails 106 to easily slide up and down along the vertical guide rails 108.

Each horizontal guide rail 106 is connected to a corresponding weight beam 112 such that they move up and down together. In this embodiment, the front end 112*a* of each weight bar 112 is connected to a first cable 120 which lifts the weight bar 112 as the user lifts the horizontal guide rail 108 with the handles 104. The first cable 120 is connected at one end to the top side of the weight bar 112 at the front end 112*a* and at the other end to the moving pulley 123. A second cable 121 is connected at the front end to the bottom side of the sleeve 110 which pulls the cable up with the horizontal guide rails as the user pulls up on the handles 104. The other end of the second cable 121 is connected to the bottom side of the sleeve 110 on the back end of the guide rail 106 and fed through the bottom horizontal beam to the front end where it is connected to a plurality of feed pulleys 122. Following the action of the pulleys 122, 123, the weight bar 112 is moved up at the same time the horizontal guide rails 106 are moved up. As shown, the cables 120, 121 are fed through a series of pulleys 122, 123 which can be arranged in various (block and tackle) configurations to provide a mechanical advantage if desired. More or fewer pulleys and/or cables can be used to achieve a particular mechanical effect. It is understood that many different cable/pulley configurations are possible.

The back end 112*b* of the weight beam 112 is pivotally connected to the vertical beam 102*b* at the pivot 114 such that it can rotate within a vertical plane while remaining at a fixed height, allowing the weight beam front end 112*a* to move up and down with the guide rail 106. Each weight beam 112 includes a cylindrical horn 116 where weight plates may be attached to adjust the weight of the weight beam 112.

An optional platform 118 is included between the two lower horizontal beams 102*a* to provide a steady surface for the user to stand on during performance of the exercises. The platform 118 may be padded or may include grips to keep the user's feet from sliding on its surface. In some embodiments, the platform 118 may be removed altogether, allowing the user to stand on the floor beneath the machine to perform the exercises.

Embodiments of the machine 100 can be installed as a stand-alone piece of equipment, or they can be integrated with another machine, for example, a squat rack, a multipurpose fitness machine, or a Smith machine. In either configuration, the machine 100 may be adjustable to accommodate users of varying height. For example, in one embodiment, the frame vertical beams 102*b* may comprise vertical legs that telescope along a plurality of lockable positions, allowing the vertical range of motion of the handles 104 to be adjusted as necessary.

Figure 2:
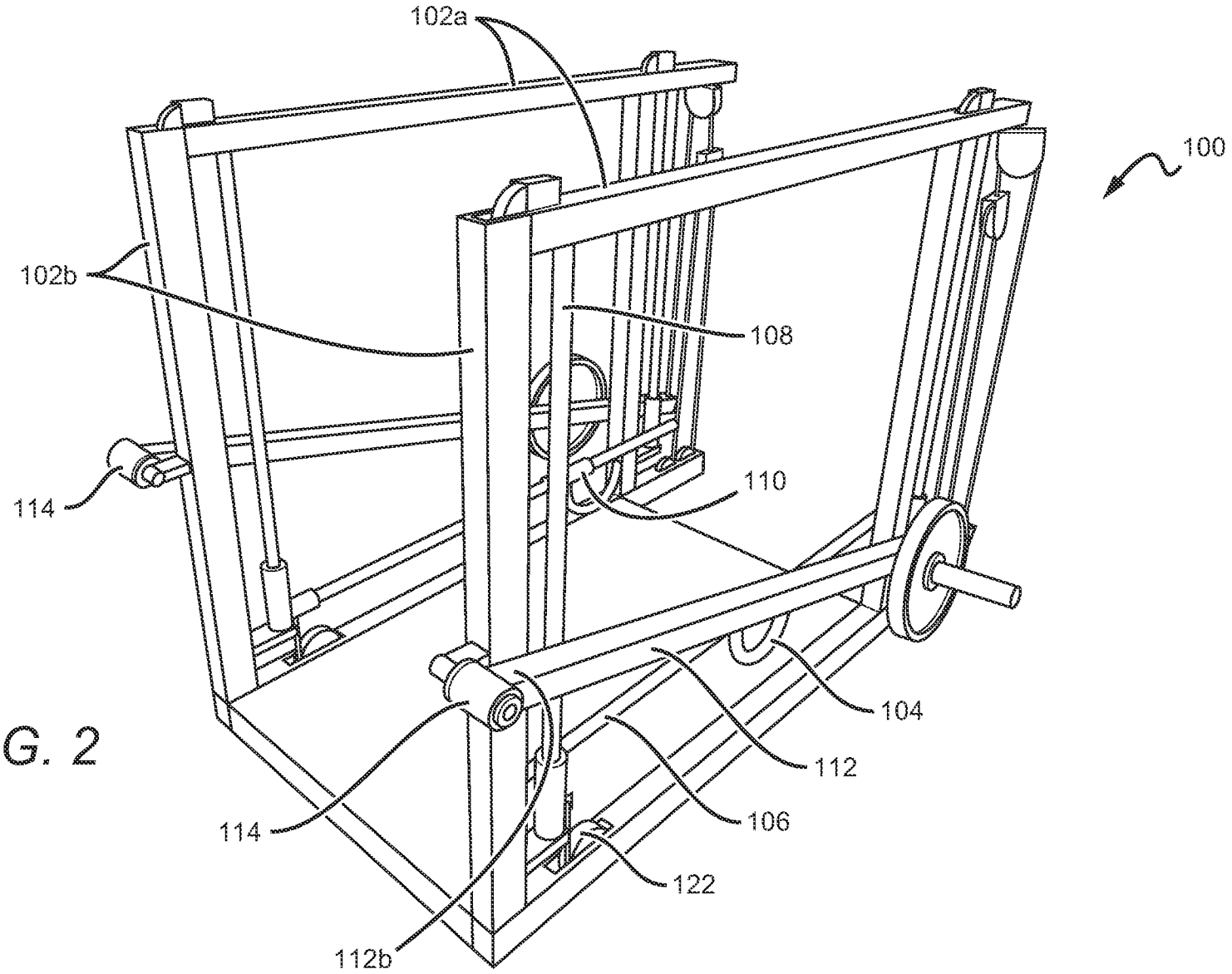
FIG. 2 is a back perspective view of the machine 100.

FIG. 2 is a back perspective view of the machine 100. Here pivots 114 are shown providing the rotatable connection between the vertical beams 102*b* and the weight bars 112. The bottom back side feed pulleys 122 are also shown. Optional top back side pulleys 125 may be used to provide counterbalance to the system, reducing the starting weight (i.e., the weight a user must lift to move the weight bar 112 when the horn 116 is not loaded).

Figure 3:
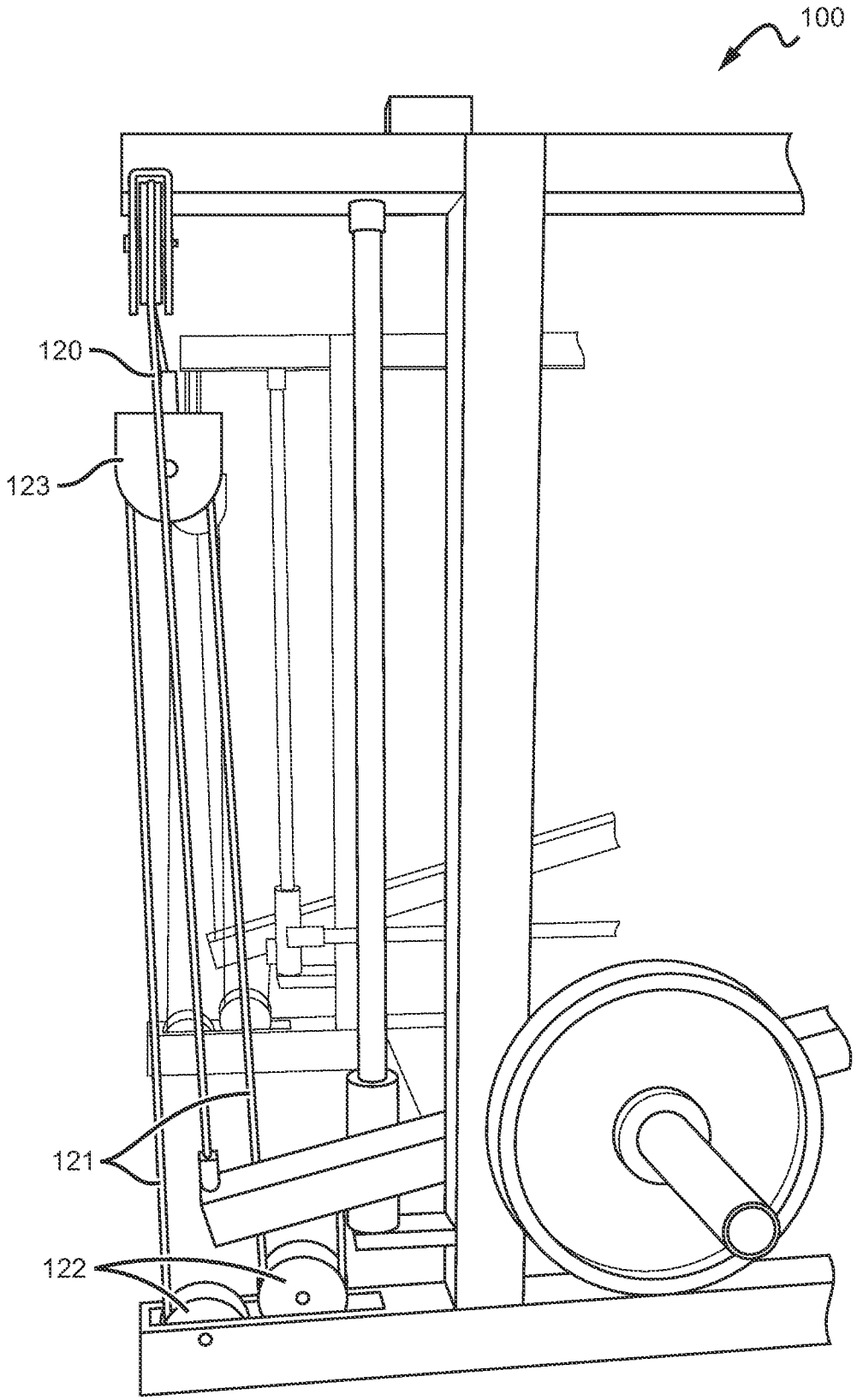
FIG. 3 is a close-up of a front portion of the machine 100.

FIG. 3 is a close-up of a front portion of the machine 100. The cables 120, 121, feed pulleys 122, and the moving pulley 123 are shown in detail. It is understood that embodiments of the machine 100 are not limited to any particular cable-and-pully configuration. Instead, it is intended that other configurations may be used to provide various mechanical advantages or effects.

Figure 4:
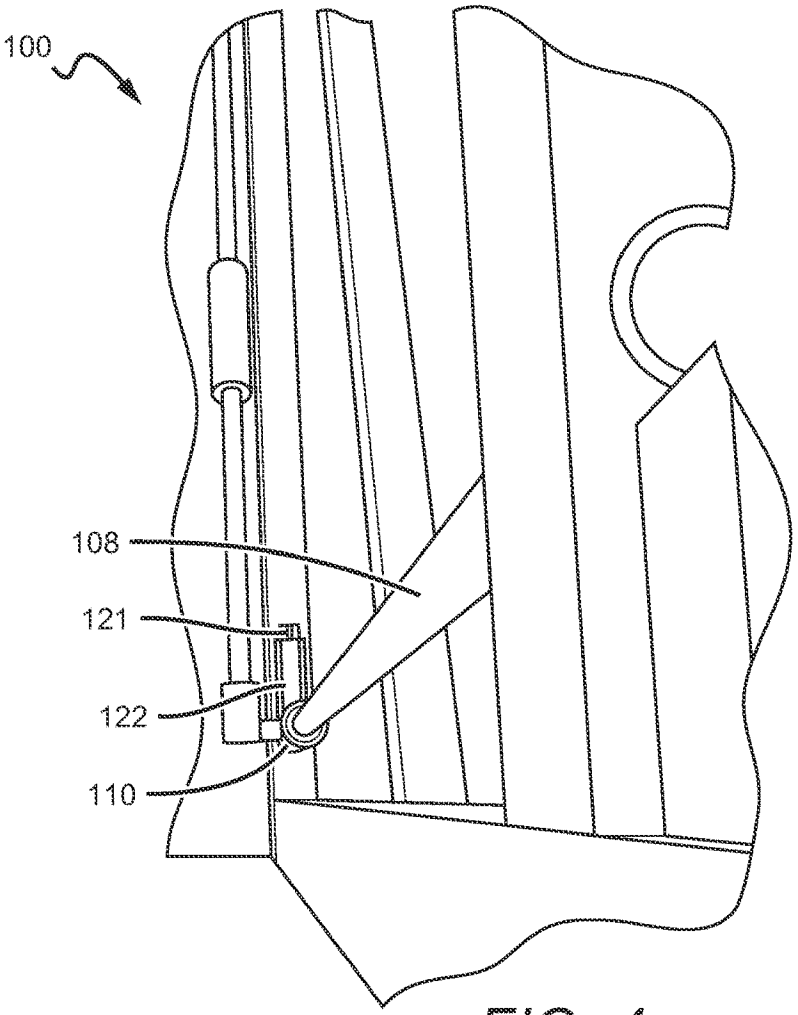
FIG. 4 is a top-down view of the back left portion of the machine 100.

FIG. 4 is a top-down view along the vertical guide rail 108 of the back left portion of the machine 100. The back side feed pulley 122 is shown which guides the cable 121 from its connection underneath the sleeve 110 through the bottom horizontal beam to the front end of the machine 100 where it is joined in the pulley system.

Figure 5:
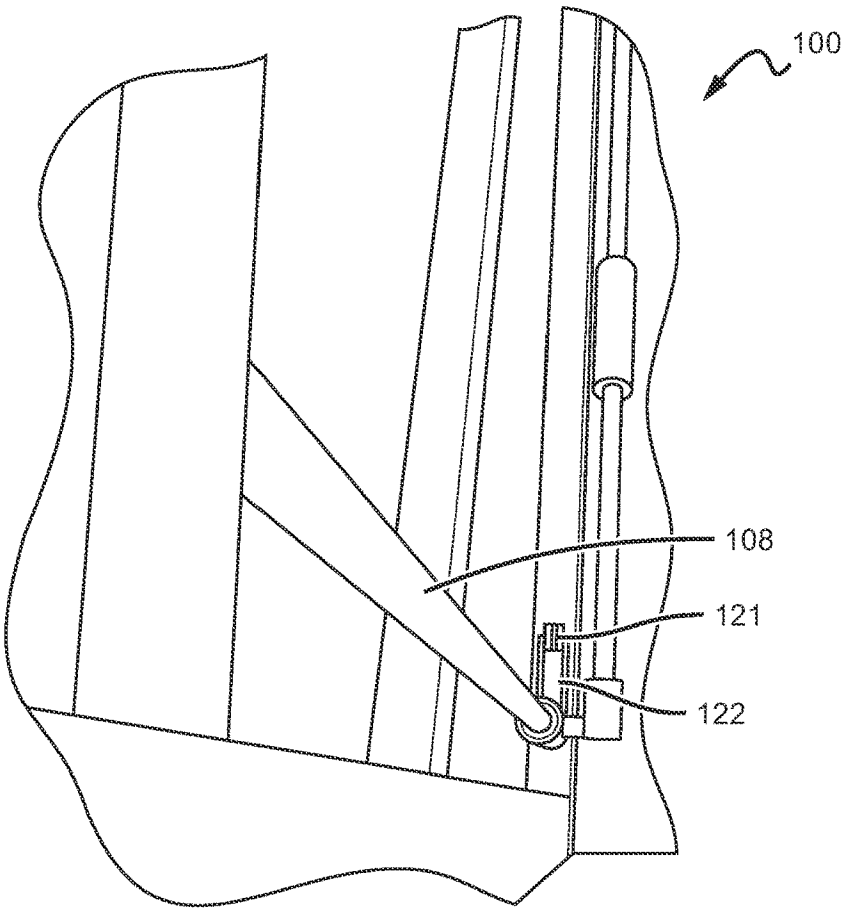
FIG. 5 is a top-down view of the back right portion of the machine 100.

FIG. 5 is a top-down view along the vertical guide rail 108 of the back right portion of the machine 100. The back side feed pulley 122 is shown which guides the cable 121 from its connection underneath the sleeve 110 through the bottom horizontal beam to the front end of the machine 100 where it feeds into the front feed pulleys 122.

Figure 6:
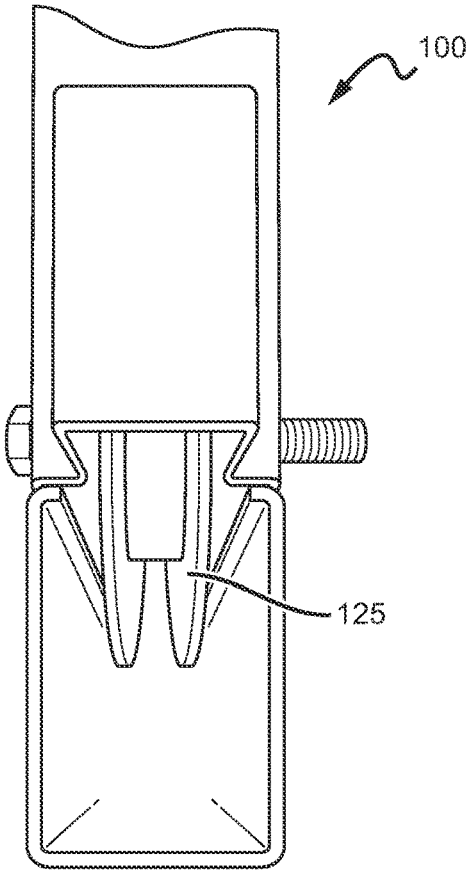
FIG. 6 is a view of the top back right portion of the machine 100.

FIG. 6 is a view of the top back right portion of the machine 100. The top back side pulley 125 which may be used for optional counterbalance is shown.

Figure 7:
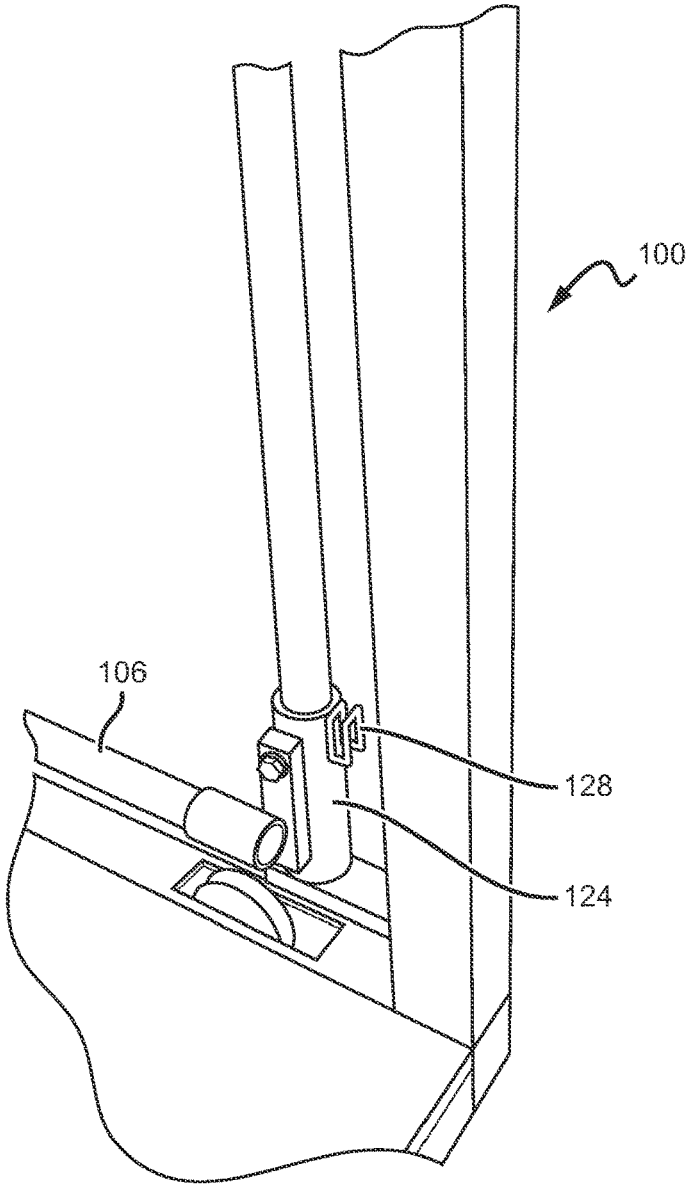
FIG. 7 is a view of the bottom back left portion of the machine 100.

FIG. 7 is a view of the bottom back left portion of the machine 100. The horizontal guide rail 106 is connected to the sleeve with carriage 124. The carriage may include cable connectors 128 on the front and or back sides to provide connection to multiple cables if, for example, counterbalance is used.

Figure 8:
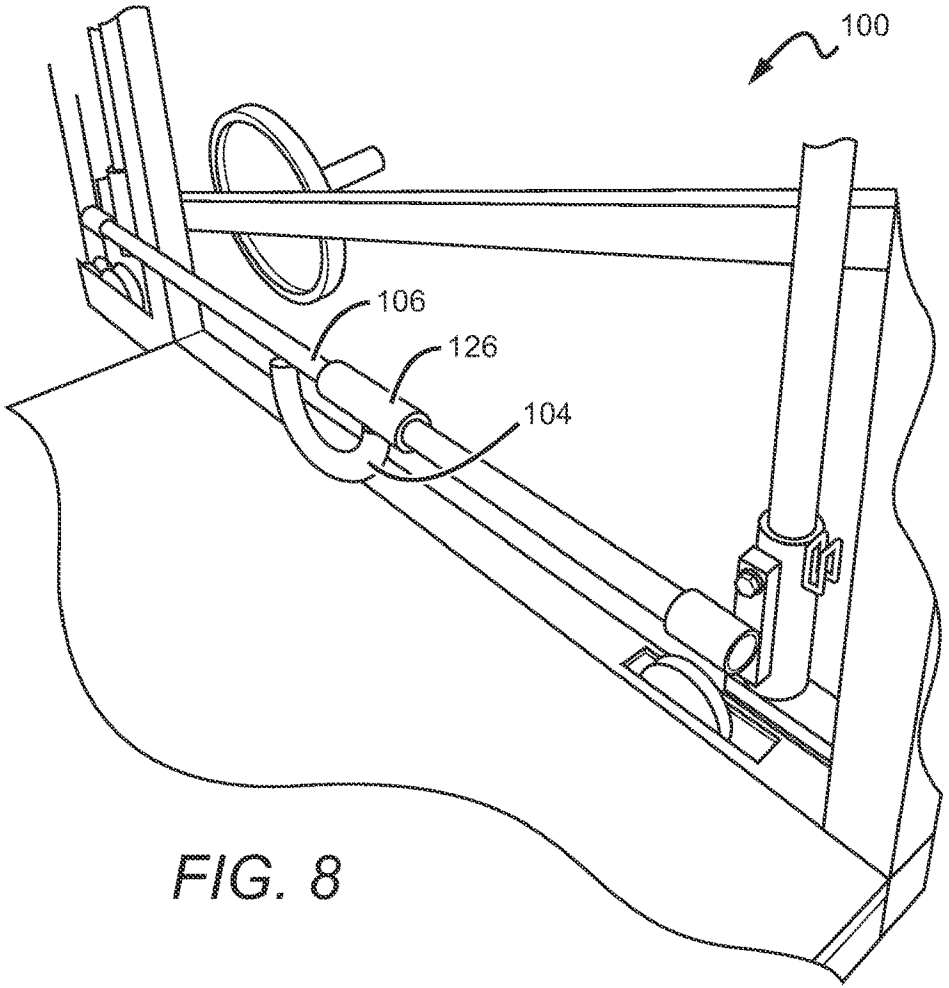
FIG. 8 is a view of the left interior side of the machine 100.

FIG. 8 is a view of the left interior side of the machine 100. The handle 104 is connected to the horizontal guide rail 106 with a handle sleeve 126 which allows the handle to slide back and forth.

Figure 9:
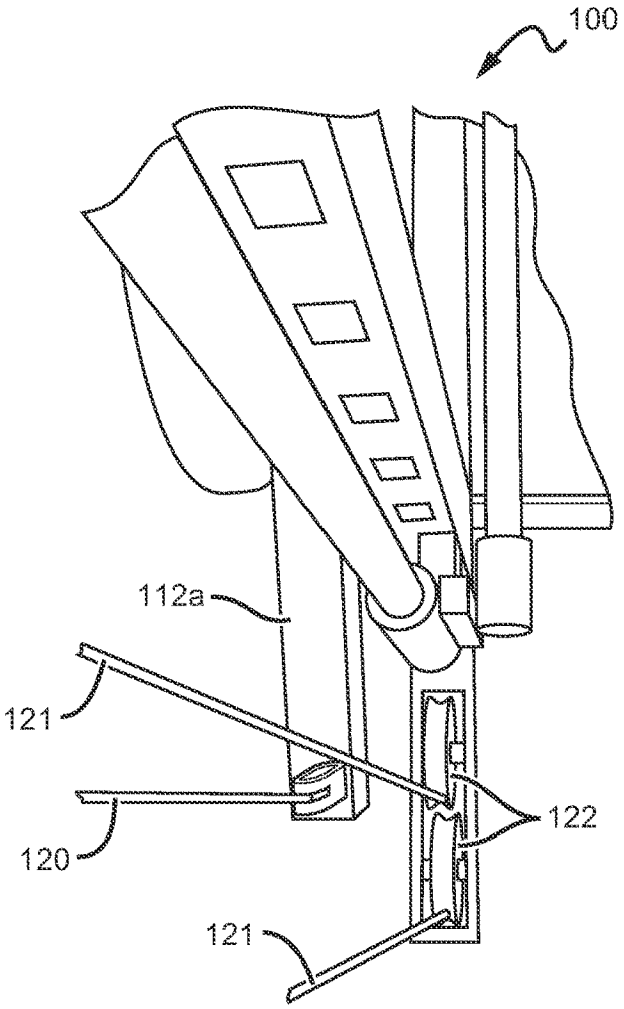
FIG. 9 is a top-down view of the left front portion of the machine 100.

FIG. 9 is a top-down view of the left front portion of the machine 100. The first cable 120 is shown connected to the top side of the weight bar front end 112*a*. The second cable 121 is shown feeding up from the feed pulleys 122 to a connection with the moving pulley 123 (best shown in FIG. 1).

Figure 10:
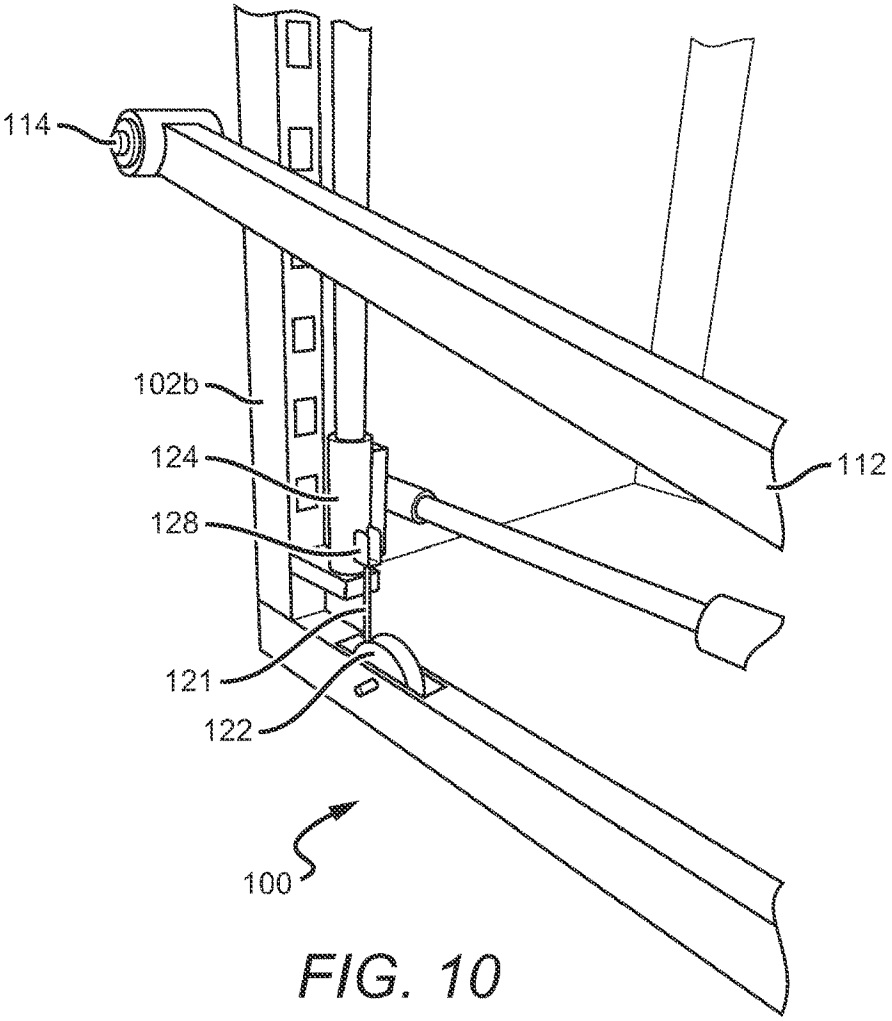
FIG. 10 is a close-up view of the back left exterior of the machine 100.

FIG. 10 is a close-up view of the back left exterior of the machine 100. The pivot 114 is shown connecting the weight bar 112 to the back vertical support beam 102*b*. Also shown, is the second cable 121 which is connected to the carriage 124 via the cable connector 128. The cable 121 is fed through back feed pulley 122 and the bottom horizontal support beam 102*a* to the front feed pulleys 122.

Figure 11:
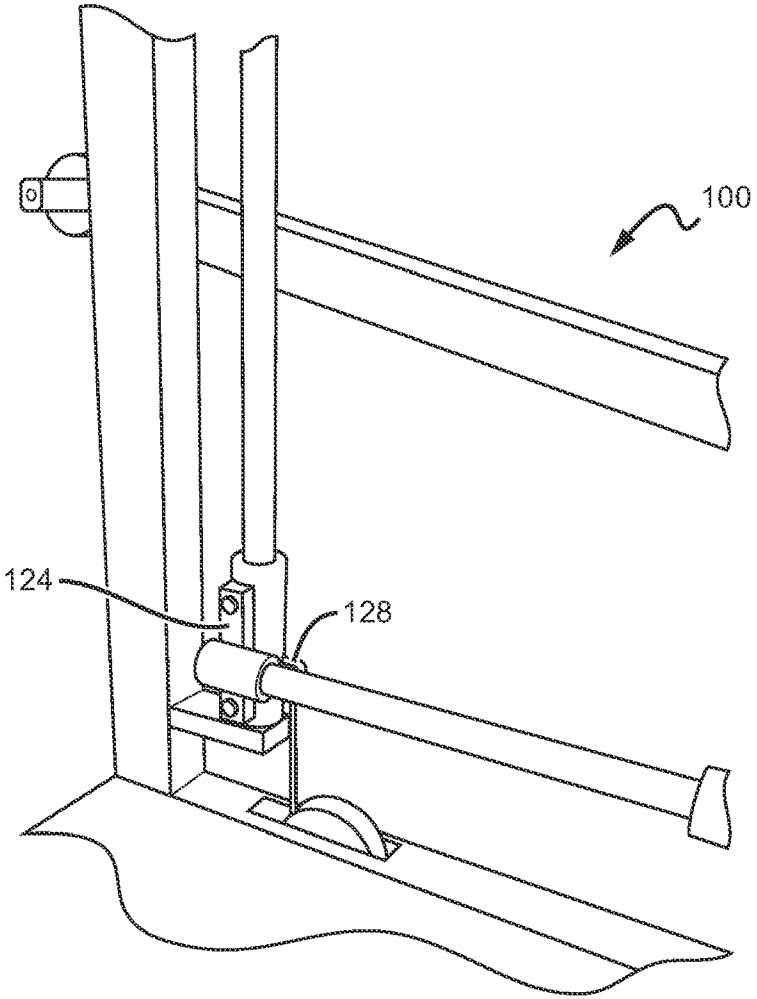
FIG. 11 is a close-up view of the back right interior of the machine 100.

FIG. 11 is a close-up view of the back right interior of the machine 100.

Figure 12:
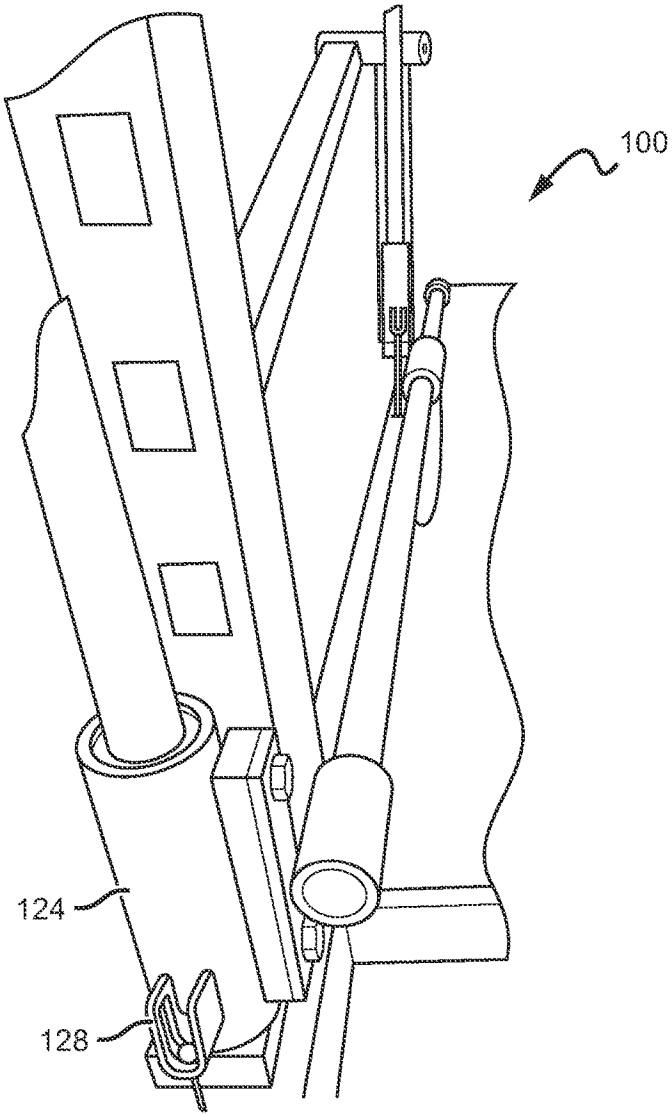
FIG. 12 is a close-up view of the front left interior of the machine.

FIG. 12 is a close-up view of the front left interior of the machine. The carriage 124 and cable connector 128 are shown.

Figure 13:
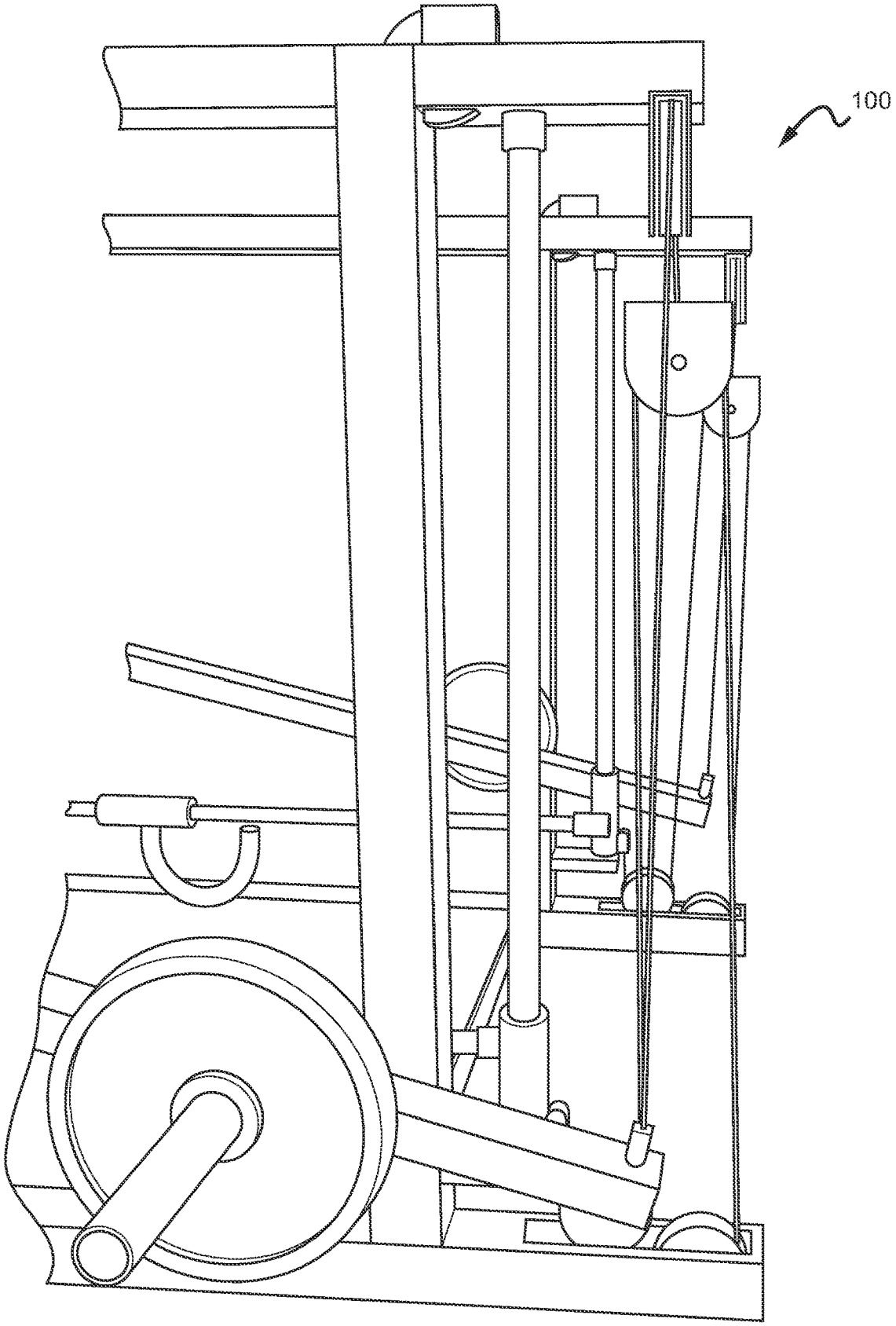
FIG. 13 is view of the front left exterior portion of the machine 100.

FIG. 13 is view of the front left exterior portion of the machine 100.

Figure 14:
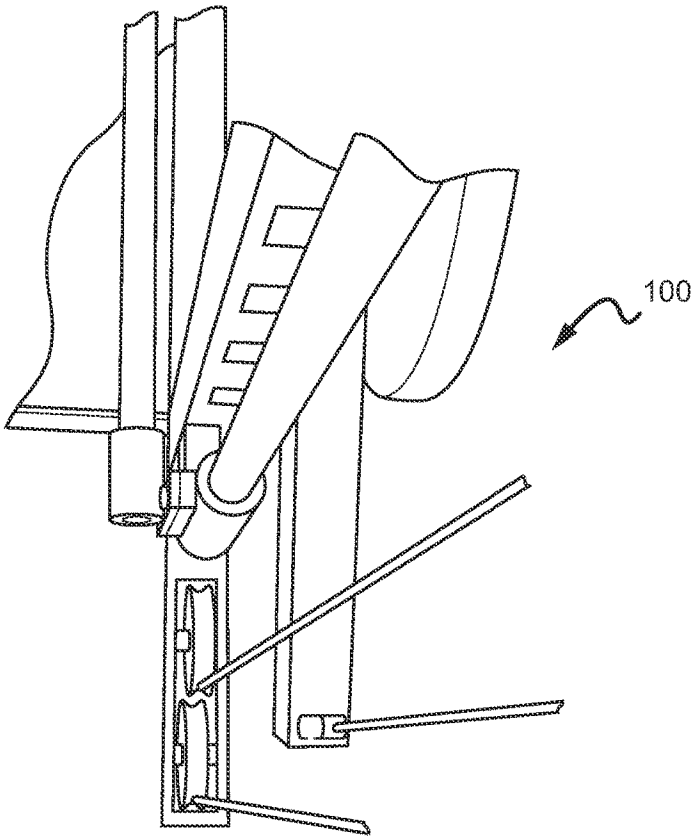
FIG. 14 is a top down view of the front right portion of the machine 100.

FIG. 14 is a top down view of the front right portion of the machine 100.

Figure 15B:
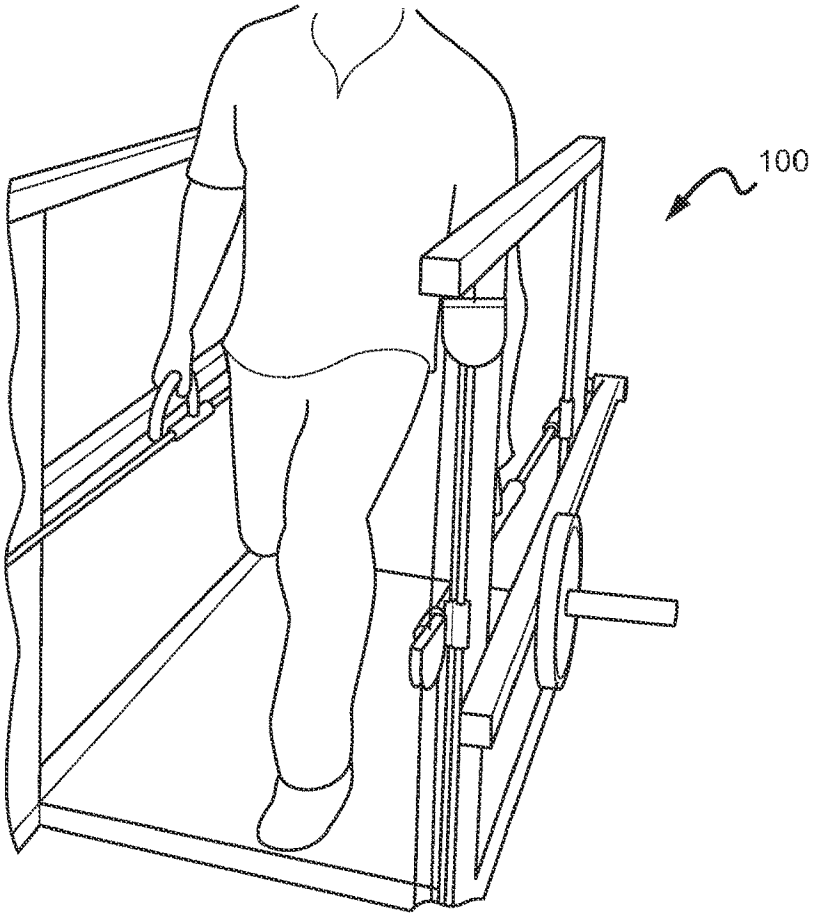
FIG. 15*b* shows a user's left leg extended forward and the user's right knee bent toward the floor while using the machine 100.
Figure 15A:
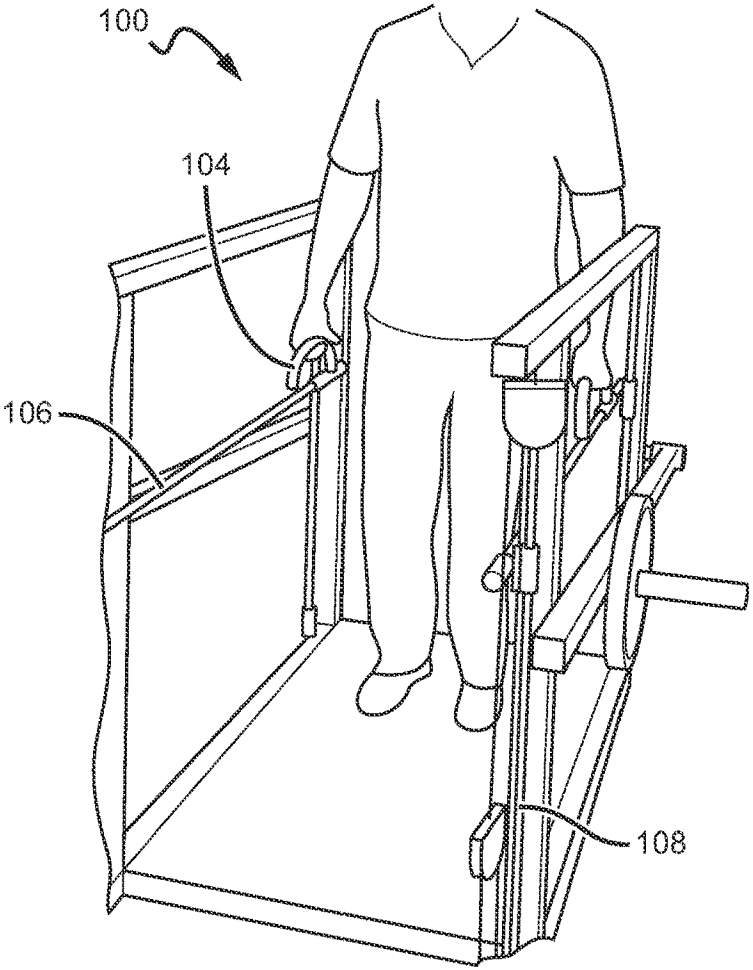
FIG. 15*a* shows a user in the upright standing ready position in the exercise space of the machine 100.

In one method of using the machine 100, the motion mimics the lunge action that a user experiences when performing a lunge-style exercise, as best shown in FIGS. 15*a* and 15*b*.

FIG. 15*a* shows a user in the upright standing position with both handles 104 gripped. FIG. 15*b* shows the user's left leg extended forward and the user's right knee bent toward the floor. During the exercise, the handles 104 slide along the horizontal guide rails 106 allowing the user's hands and arms to move comfortably in a lateral direction to accommodate the forward and backward motion of the body during the lunge. The horizontal guide rails 106 move up and down along the vertical guide rails 108 to allow the user's hands and arms to move vertically during the exercise. Thus, the user's hands and arms are in a comfortable, natural position throughout the entire range of motion of the exercise. The handles 104 and the horizontal guide rails 106 significantly improve the user's balance during the exercise, eliminating unnecessary stress on the knees, hips, and lower back. The counterweight system ensures that the starting weight is manageable for all users. One suitable starting weight is approximately 17 lbs., although it is understood that the starting weight may be easily adjusted as desired.

Figure 16B:
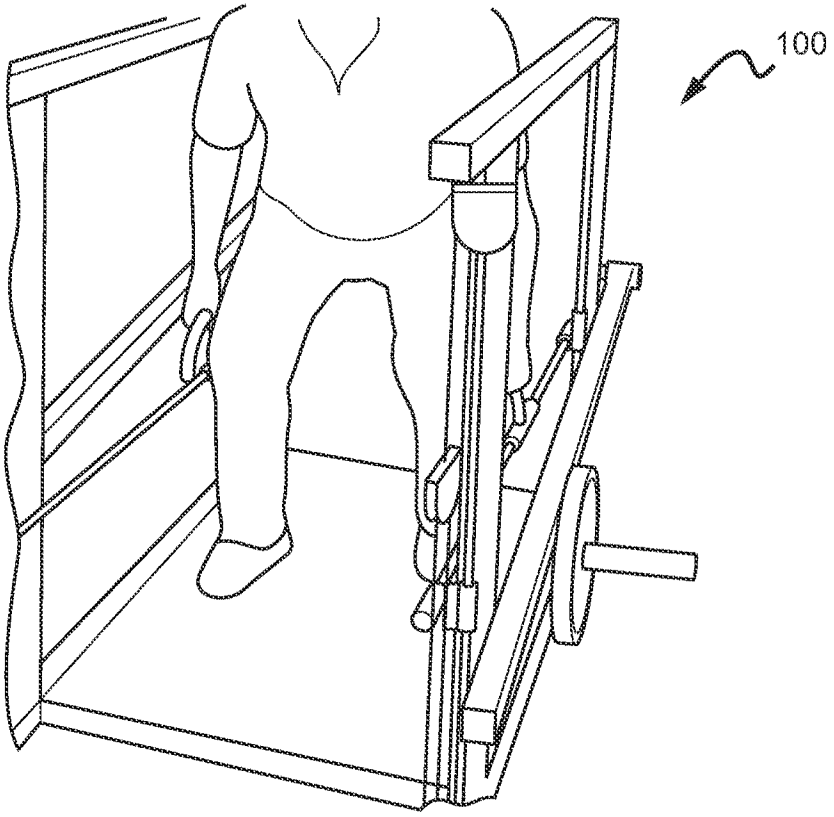
FIGS. 16*a* and 16*b* show another method of use of the machine 100.
Figure 16A:
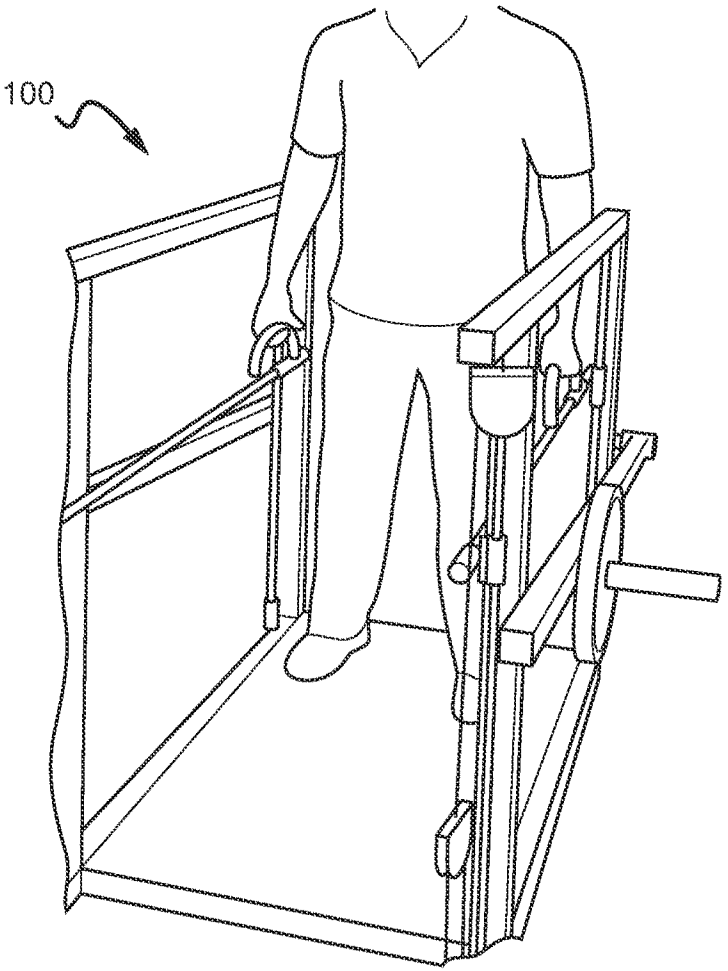
Figure 18:
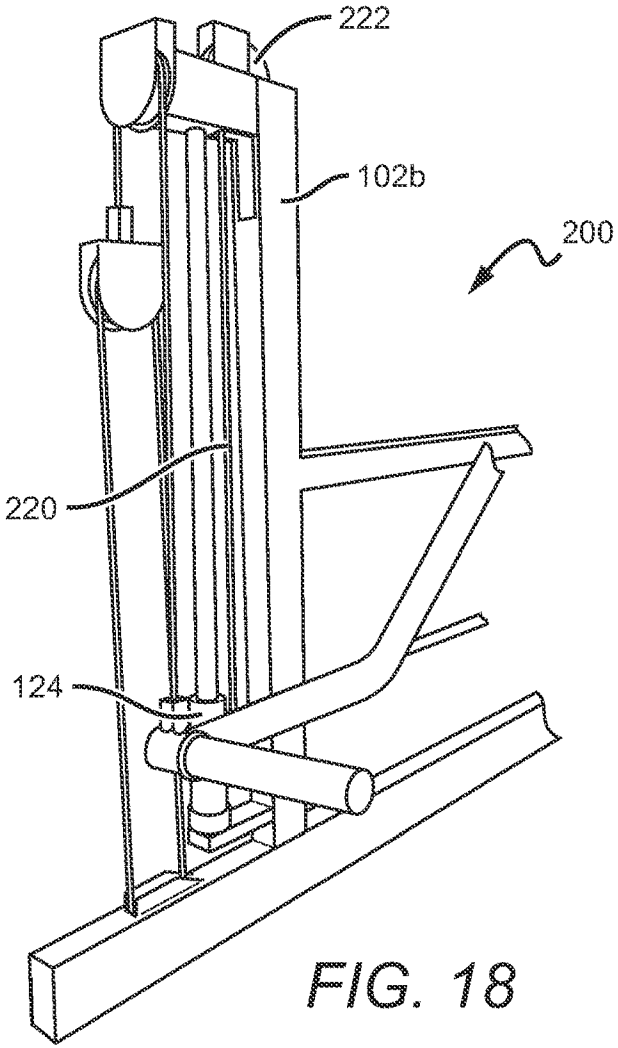
FIG. 18 shows a view from the exterior of a front right portion of the fitness machine 200.

FIGS. 16*a* and 16*b* show another method of use of the machine 100. This motion mimics a kettlebell squat-style motion, where both legs are bent in unison. It is understood that the machine may be used for any number of additional exercises not specifically disclosed herein.

FIGS. 17-20 show another embodiment of a multi-use fitness machine 200 according to the present disclosure. The machine 200 is similar to the machine 100 in many respects and shares several elements in common which are indicated using the same reference numerals. In this embodiment, the weight beam 212 has a segmented shape. A front segment 212*a* is horizontal when the weight beam 212 is in the resting position as show in the FIG. 17. A second segment 212*b* is angled up away from the floor. The third segment 212*c* is horizontal but higher above the floor than the first segment 212*a*. The second segment 212*b* joins the first and second segments 212*a*, 212*c*. The segmented weight beam 212 distributes the weight more efficiently and improves the overall balance of the machine 200.

Figure 17:
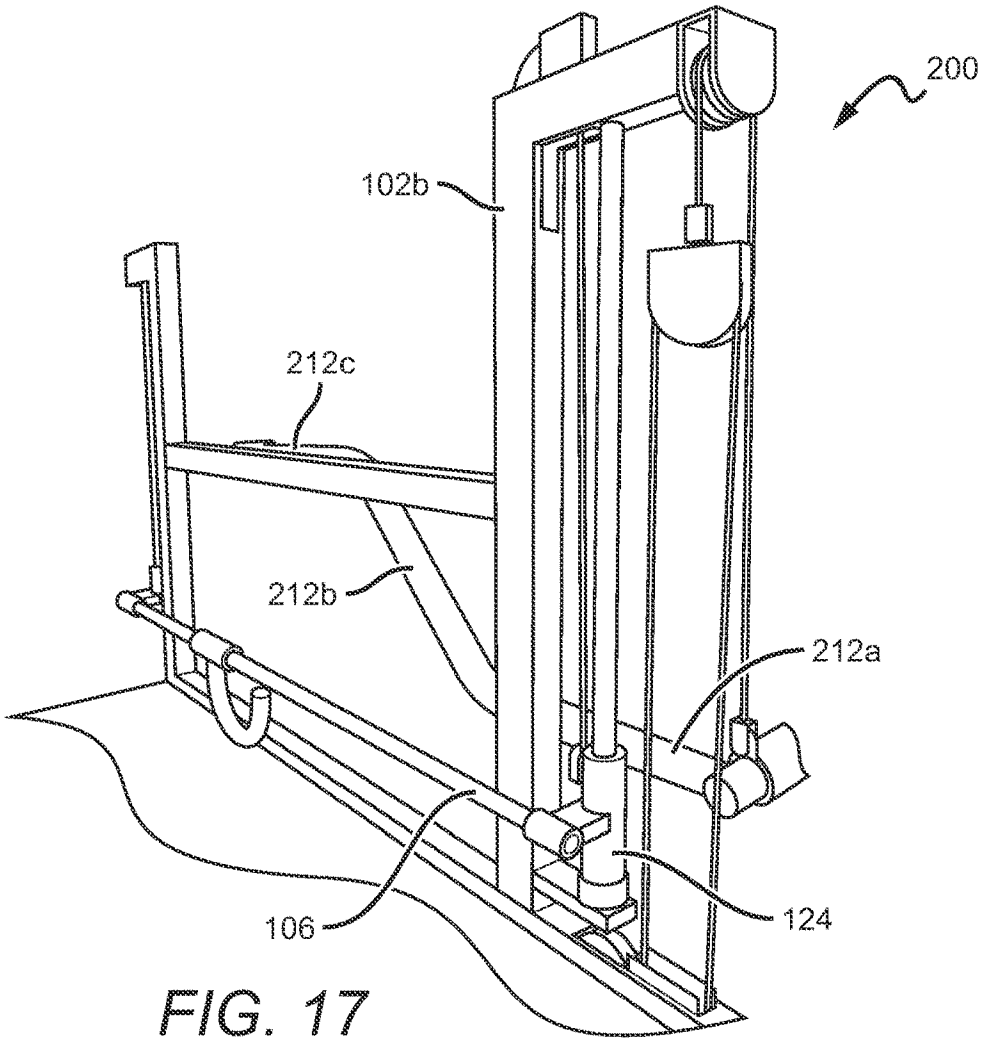
FIG. 17 shows a view from the interior of a front right portion of another fitness machine 200 according to the present disclosure.
Figure 20:
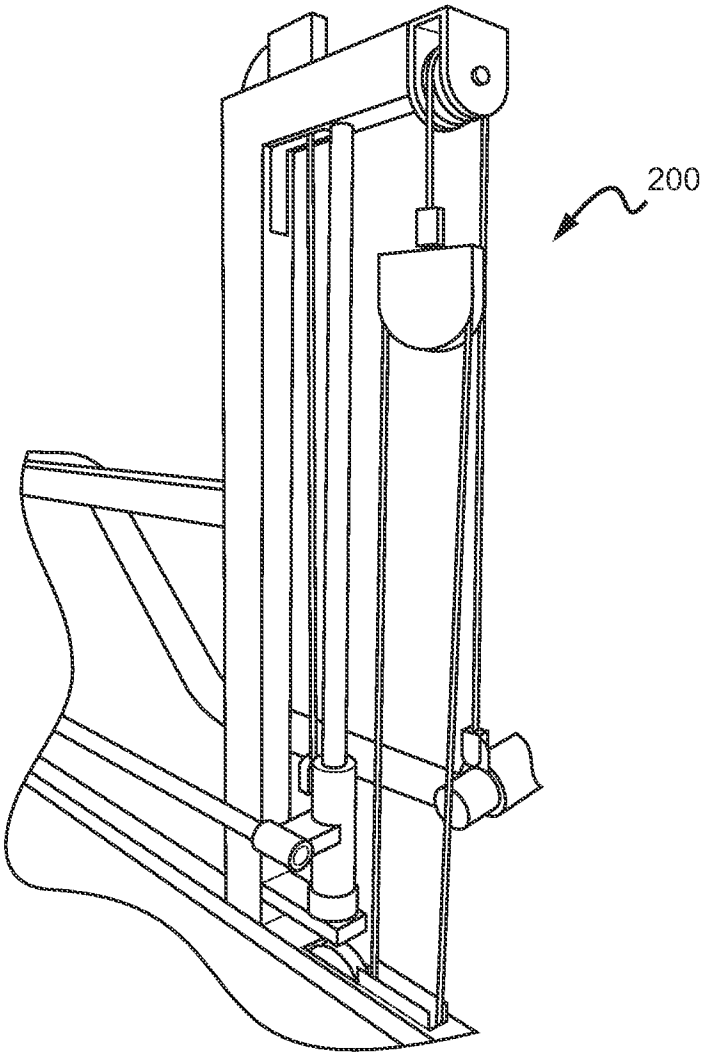
FIG. 20 is a view from the interior of the front right portion of the machine 200.
Figure 19:
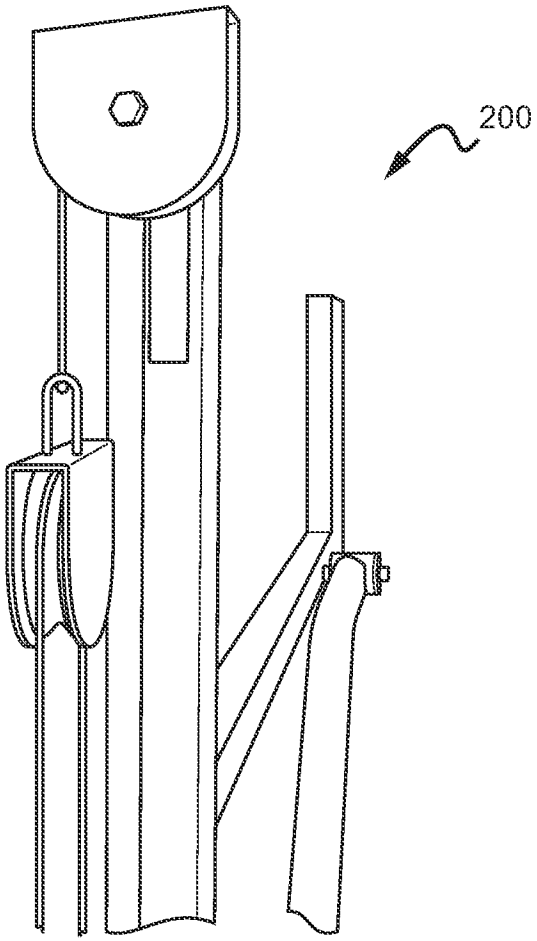
FIG. 19 is a close-up view of the top right portion of the machine 200.

In this embodiment, as best shown in FIG. 17, a third cable 220 is connected through a top side pulley 222 to a counterweight (not shown) which is housed within the front vertical support beam 102*b*. The counterweight is connected via cable 220 to the carriage 124 of the horizontal guide rail 106 to provide counterbalance, reducing the starting weight for the user.

Figure 21:
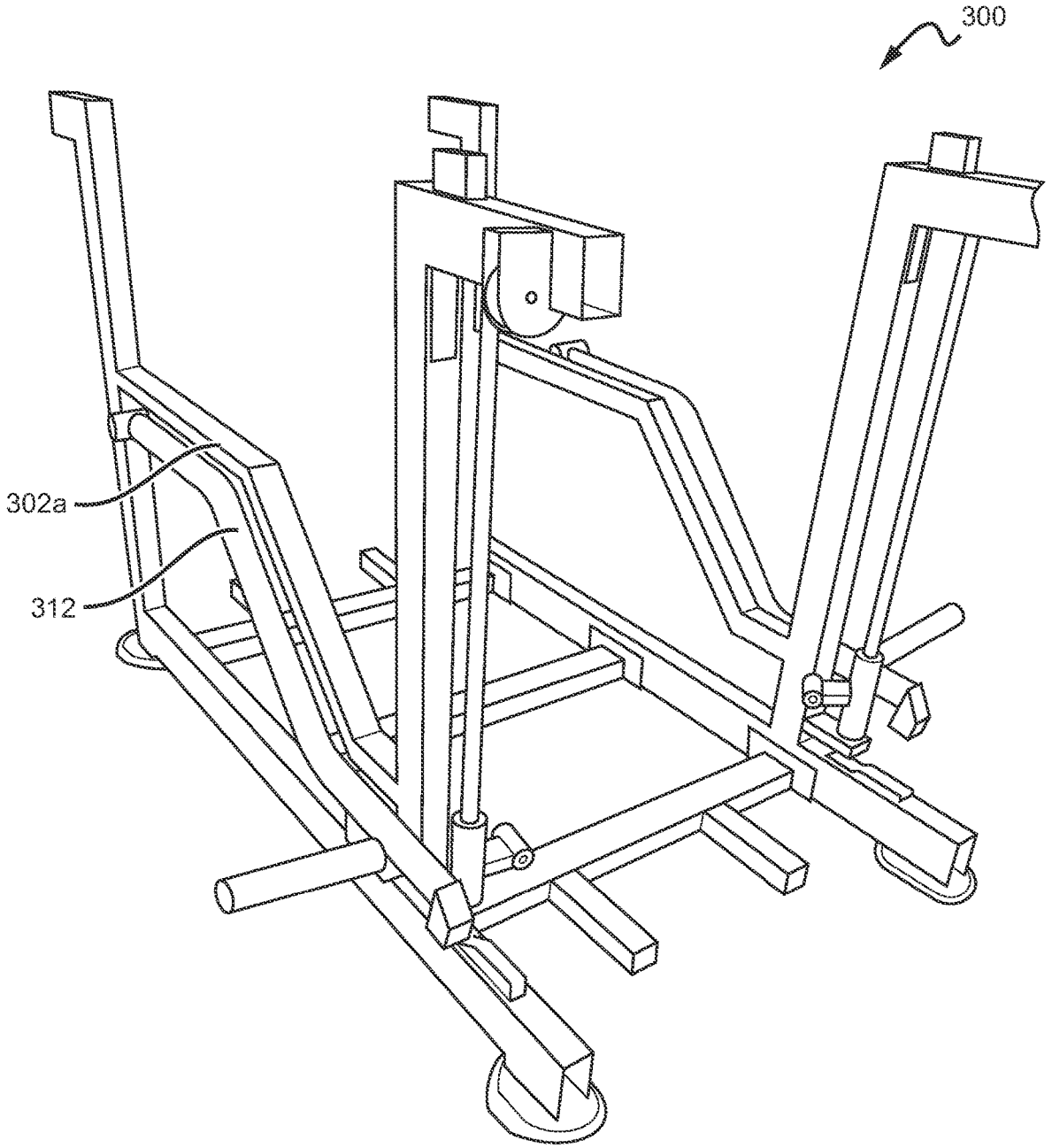
FIG. 21 is a perspective view of another fitness machine 300 according to the present disclosure.

FIG. 21 shows another embodiment of a multi-use fitness machine 300 according to the present disclosure. The machine 300 is similar to the machines 100, 200 in many respects and shares several elements in common which are indicated using the same reference numerals. In this embodiment, the weight beam 312 has the same segmented shape as the weight beam 212 in the machine 200. However, the horizontal support beams 302*a* of the machine 300 are also segmented to run alongside the weight beams 312, giving the machine 300 a more streamlined look and improving the overall balance of the machine 300. All cables are shown disconnected in this figure.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A fitness machine, comprising:

a frame defining an interior exercise space;

at least one horizontal guide rail;

a handle connected separately to each of said at least one horizontal guide rails, such that each of said handles can slide horizontally along a length of a corresponding one of said horizontal guide rails;

at least one sleeve attached to said at least one horizontal guide rail, said at least one sleeve oriented vertically and shaped to define a vertical hole there through;

at least one vertical guide rail attached to said frame, said vertical guide rail passing through said hole of said sleeve, such that said sleeve can slide vertically along a distance of said vertical guide rail; and a weight beam comprising a first end that is pivotally connected to said frame and a second end that is connected to at least one cable such that said second end moves vertically as said horizontal guide rail moves vertically.

2. The fitness machine of claim 1, said weight beam further comprising a horn proximate to said second end of said weight beam, said horn shaped to receive weight plates.

3. The fitness machine of claim 1, said weight beam further comprising a horizontal front segment, a horizontal back segment, and an angled segment connecting said front and back horizontal segments.

4. The fitness machine of claim 1, further comprising a platform attached to a base of said frame within said interior exercise space.

5. The fitness machine of claim 1, said frame comprising:

first and second bottom horizontal support beams and at least one crossbeam connected between said first and second bottom horizontal beams to form a base;

a plurality of top horizontal support beams;

first and second front vertical support beams extending vertically up from said base;

first and second back vertical support beams extending vertically up from said base;

wherein said at least one vertical guide rail comprises first and second front vertical guide rails and first and second back vertical guide rails, said first front vertical guide rail connected to said frame and extending between said first bottom horizontal support beam and one of said top horizontal support beams, said second front vertical guide rail connected to said frame and extending between said second bottom horizontal support beam and one of said top horizontal support beams, said first back vertical guide rail connected to said frame and extending between said first bottom horizontal support beam and one of said top horizontal support beams, said second back vertical guide rail connected to said frame and extending between said second bottom horizontal support beam and one of said top horizontal support beams;

wherein each of said horizontal guide rails is connected at a front end by one of said sleeves to one of said front vertical guide rails and at a back end by another of said sleeves to a corresponding one of said back vertical guide rails.

6. The fitness machine of claim 1, further comprising a counterbalance weight connected via at least one cable to said at least one horizontal guide rail to adjust a starting weight of said exercise machine.

7. The fitness machine of claim 1, said frame comprising:

a base;

a front vertical support beam extending up from said base; and a back vertical support beam extending up from said base, said front and back vertical support beams defining a first plane, wherein said handle can move both horizontally and vertically in a second plane that is parallel to said first plane.

8. An exercise machine, comprising:

a frame defining a rectangular interior exercise space;

first and second pairs of vertical guide rails connected to said frame;

first and second horizontal guide rails, said first horizontal guide rail connected between said first pair of vertical guide rails such that said first horizontal guide rail can slide vertically along said first pair of vertical guide rails, said second horizontal guide rail connected between said second pair of vertical guide rails such that said second horizontal guide rail can slide vertically along said second pair of vertical guide rails; and a plurality of handles, each of said handles separately connected to a corresponding one of said horizontal guide rails such that said handles can slide horizontally along said horizontal guide rails; and a weight beam comprising a first end that is pivotally connected to said frame and a second end that is connected to one of said horizontal guide rails via at least one cable such that said second end moves vertically as said horizontal guide rail moves vertically.

9. The exercise machine of claim 8, said weight beam further comprising a horn proximate to said second end of said weight beam, said horn shaped to receive weight plates.

10. The exercise machine of claim 8, said weight beam further comprising a horizontal front segment, a horizontal back segment, and an angled segment connecting said front and back horizontal segments.

11. The exercise machine of claim 8, further comprising a platform attached to a base of said frame within said rectangular interior exercise space.

12. A fitness machine, comprising:

a frame defining an interior exercise space, said frame comprising:

first and second bottom horizontal support beams and at least one crossbeam connected between said first and second bottom horizontal beams to form a base;

a plurality of top horizontal support beams;

first and second front vertical support beams extending vertically up from said base; and first and second back vertical support beams extending vertically up from said base;

a handle connected separately to each of said at least one horizontal guide rails, such that each of said handles can slide horizontally along a length of a corresponding one of said horizontal guide rails; at least one sleeve attached to said at least one horizontal guide rail, said at least one sleeve oriented vertically and shaped to define a vertical hole there through; and at least one vertical guide rail attached to said frame, said vertical guide rail passing through said hole of said sleeve, such that said sleeve can slide vertically along a distance of said vertical guide rail; wherein each of said horizontal guide rails is connected at a front end by one of said sleeves to one of said front vertical guide rails and at a back end by another of said sleeves to a corresponding one of said back vertical guide rails wherein said at least one vertical guide rail comprises first and second front vertical guide rails and first and second back vertical guide rails, said first front vertical guide rail connected to said frame and extending between said first bottom horizontal support beam and one of said top horizontal support beams, said second front vertical guide rail connected to said frame and extending between said second bottom horizontal support beam and one of said top horizontal support beams, said first back vertical guide rail connected to said frame and extending between said first bottom horizontal support beam and one of said top horizontal support beams, said second back vertical guide rail connected to said frame and extending between said second bottom horizontal support beam and one of said top horizontal support beams.

* * * * *